United States Patent [19]

Carr et al.

[11] 4,377,464

[45] Mar. 22, 1983

[54] COAL LIQUEFACTION PROCESS

[75] Inventors: Norman L. Carr, Allison Park; William G. Moon, Cheswick; Michael E. Prudich, Pittsburgh, all of Pa.

[73] Assignee: The Pittsburg & Midway Coal Mining Co., Englewood, Colo.

[21] Appl. No.: 298,642

[22] Filed: Sep. 3, 1981

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,488,278 | 1/1970 | Nelson | 208/10 |
| 3,594,304 | 7/1971 | Seitzer et al. | 208/8 LE |
| 3,726,785 | 4/1973 | Keller et al. | 208/8 LE |
| 3,790,467 | 2/1974 | Fiocco et al. | 208/53 X |
| 3,884,794 | 5/1975 | Bull et al. | 208/10 X |
| 4,045,329 | 8/1977 | Johanson et al. | 208/10 |
| 4,081,358 | 3/1978 | Tan | 208/8 R |
| 4,152,244 | 5/1979 | Raichle et al. | 208/10 X |
| 4,159,236 | 6/1979 | Schmid | 208/10 |
| 4,159,237 | 6/1979 | Schmid | 208/8 LE |
| 4,179,352 | 12/1979 | Effron | 208/8 LE |
| 4,189,374 | 2/1980 | Kirby et al. | 208/10 X |
| 4,189,375 | 2/1980 | Kirby et al. | 208/10 X |
| 4,203,823 | 5/1980 | Carr et al. | 208/10 |
| 4,211,631 | 7/1980 | Carr et al. | 208/10 X |
| 4,222,848 | 9/1980 | Carr et al. | 208/10 X |

*Primary Examiner*—Delbert E. Gantz
*Assistant Examiner*—William G. Wright
*Attorney, Agent, or Firm*—Deane E. Keith; Forrest D. Stine; Alvin E. Ring

[57] ABSTRACT

A $C_5$-900° F. ($C_5$-482° C.) liquid yield greater than 50 weight percent MAF feed coal is obtained in a coal liquefaction process wherein a selected combination of higher hydrogen partial pressure, longer slurry residence time and increased recycle ash content of the feed slurry are controlled within defined ranges.

10 Claims, 2 Drawing Figures

COAL LIQUEFACTION PROCESS

The Government of the United States of America has rights in this invention pursuant to Contracts Nos. ET-78-C-01-3055 and DE-AC05-78ORO3055 awarded by the U.S. Department of Energy to The Pittsburg & Midway Coal Mining Co., a subsidiary of Gulf Oil Corporation.

FIELD OF THE INVENTION

This invention relates to an improved coal liquefaction process for producing increased yields of $C_5$-900° F. ($C_5$-482° C.) liquid product. More particularly, this invention relates to a coal liquefaction process for producing total liquid yields in excess of 50 weight percent MAF feed coal by using a selected combination of process conditions.

BACKGROUND OF THE INVENTION

Coal liquefaction processes have been developed for converting coal to a liquid fuel product. For example, U.S. Pat. No. 3,884,794 to Bull et al discloses a solvent refined coal process for producing reduced or low ash hydrocarbonaceous solid fuel and hydrocarbonaceous distillate liquid fuel from ash-containing raw feed coal in which a slurry of feed coal and recycle solvent is passed through a preheater and dissolver in sequence in the presence of hydrogen, solvent and recycled coal minerals, which increase the liquid product yield.

Although broad ranges of temperature, hydrogen partial pressure, residence time and ash recycle are disclosed, it has been generally believed that commercially workable conditions for achieving the highest total liquid yields involve a hydrogen partial pressure of about 2,000 psi, a slurry residence time of about 1 hour and the use of about 7 weight percent recycle ash in the slurry feed, while achieving a total liquid yield of approximately 35 to 40 weight percent based upon MAF feed coal.

SUMMARY OF THE INVENTION

A coal liquefaction process has now been found for producing a total liqid yield ($C_5$-900 ° F., $C_5$-482° C.) greater than 50 weight percent based upon MAF feed coal, which process comprises passing hydrogen and a feed slurry comprising mineral-containing feed coal, recycle normally solid dissolved coal, recycle mineral residue and a liquid solvent to a coal liquefaction zone. Recycle mineral residue comprises undissolved organic matter and inorganic mineral matter. The inorganic mineral matter is designated herein as "ash", even though it has not gone through a combustion process. The coal is a medium to high reactivity (with respect to liquefaction) coal of the bituminous type. Among the analytical characteristics which distinguish this coal are a total sulfur content of greater than 3 weight percent (MF coal basis) of which at least 40% is pyritic sulfur, a total reactive maceral content (defined as vitrinite+pseudovitrinite+exinite) of greater than 80 volume percent (MAF coal basis), and a mean maximum reflectance of vitrinite+pseudonitrinite of less than 0.77. The catalytic activity of the pyrite/pyritic sulfur in the coal may be replaced by a slurry catalyst, if desired. The recycle ash is present in the feed slurry in an amount greater than about 8 weight percent based on the weight of the total feed slurry, and the feed slurry is reacted in the coal liquefaction zone under a hydrogen partial pressure of between about 2,100 to about 4,000 psi under three-phase, backmixed, continuous flow conditions at a slurry residence time of between about 1.2 to about 2 hours. Unexpectedly, a judicious selection of values for recycle ash, hydrogen partial pressure and slurry residence time within the foregoing ranges provides a $C_5$-900° F. ($C_5$-482° C.) liquid yield of between about 50 to about 70 weight percent based upon MAF feed coal.

Surprisingly, the total liquid yield increase obtainable by the present process is as much as twice that which could be expected from the additive effect of separately increasing each of the variables of hydrogen partial pressure, slurry residence time or amount of ash or mineral residue recycled. For example, the additive improvement in total liquid yield predicted by increasing the aforesaid process variables is from about 14 to about 19 percent; however, the actual yield improvement was found to be about 28 percent by operating in accordance with the process of the present invention.

DESCRIPTION OF THE PREFERRED EMBODIMENTS

Figure 1:
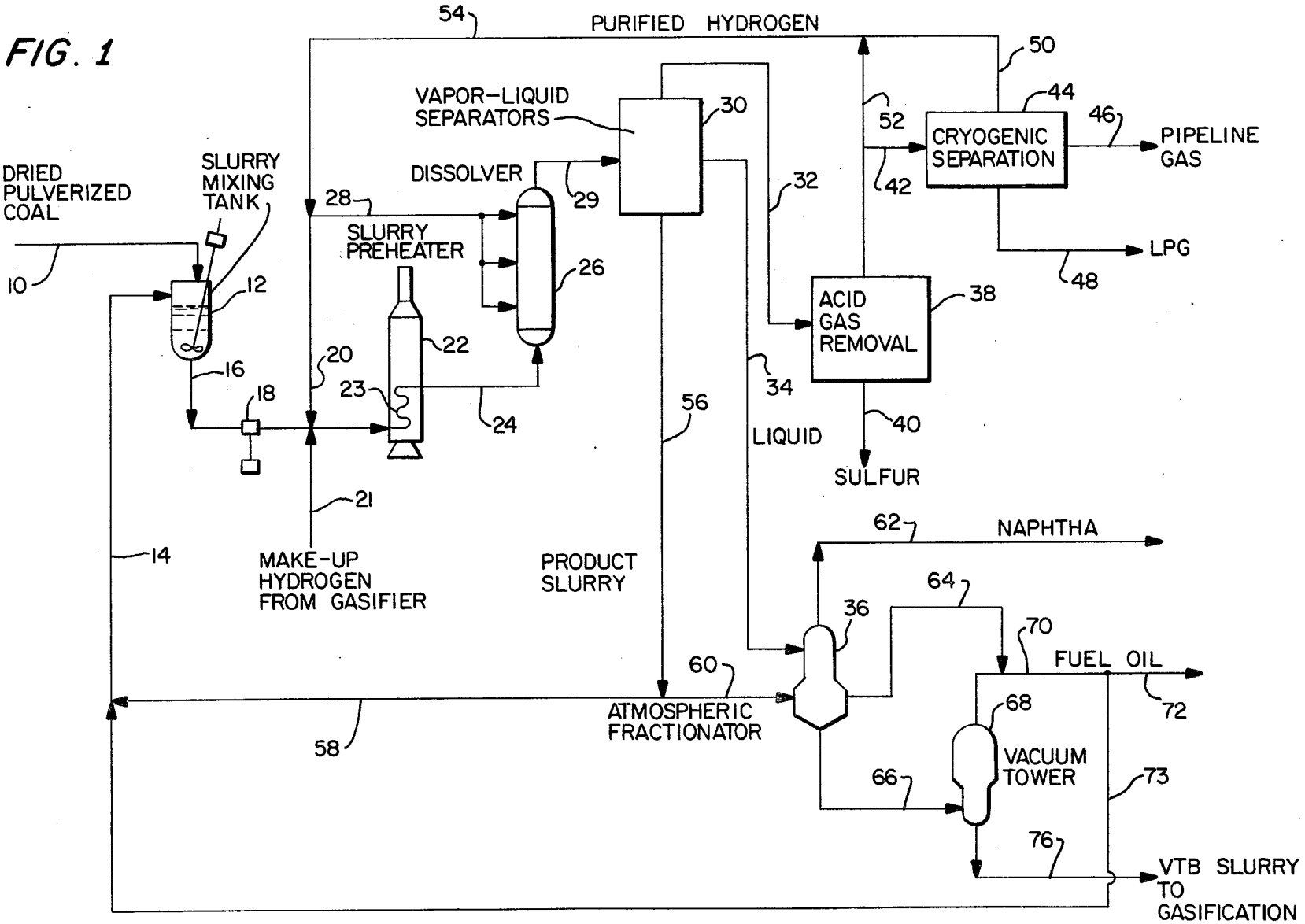
FIG. 1 is a schematic flow diagram of the process of the present invention.

As shown in the process set forth in FIG. 1 of the drawings, dried and pulverized raw coal is passed through line 10 to slurry mixing tank 12 wherein it is mixed with recycle slurry containing recycle normally solid dissolved coal, recycle mineral residue and recycle distillate solvent boiling, for example, in the range of between about 350° F. (177° C.) to about 900° F. (482° C.) flowing in line 14. The expression "normally solid dissolved coal" refers to 900° F.+ (482° C.+) dissolved coal which is normally solid at room temperature.

The resulting solvent-containing feed slurry mixture contains greater than about 8 weight percent, preferably from about 8 to about 14, and most preferably from about 10 to about 14 weight percent recycle ash based on the total weight of the feed slurry in line 16. The feed slurry contains from about 20 to 35 weight percent coal, preferably between about 23 to about 30 weight percent coal and is pumped by means of reciprocating pump 18 and admixed with recycle hydrogen entering through line 20 and with make-up hydrogen entering through line 21 prior to passage through preheater tube 23, which is disposed in furnace 22. The preheater tube 23 preferably has a high length to diameter ratio of at least 100 or 1000 or more.

The slurry is heated in furnace 22 to a temperature sufficiently high to initiate the exothermic reactions of the process. The temperature of the reactants at the outlet of the preheater is, for example, from about 700° F. (371° C.) to 760° F. (404° C.). At this temperature the coal is essentially all dissolved in the solvent, but the exothermic hydrogenation and hydrocracking reactions have not yet begun. Whereas the temperature gradually increases along the length of the preheater tube, the back mixed dissolver is at a generally uniform temperature throughout and the heat generated by the hydrocracking reactions in the dissolver raises the temperature of the reactants, for example, to the range of from about 820° F. (438° C.) to about 870° F. (466° C.). Hydrogen quench passing through line 28 is injected into the dissolver at various points to control the reaction temperature.

The temperature conditions in the dissolver can include, for example, a temperature in the range of from about 430° to about 470° C. (806° to 878° F.), preferably from about 445° to about 465° C. (833° to 871° F.). However, unlike the process variables of residence time, hydrogen partial pressure and recycle ash concentrations, temperature was not found to have as critical an effect upon increasing the $C_5$-900° F. ($C_5$-482° C.) yield. Use of the highest level in this range is preferred.

The slurry undergoing reaction is subjected to a relatively long total slurry residence time of from about 1.2 to about 2 hours, preferably from about 1.4 to about 1.7 hours, which includes the nominal residence time at reaction conditions within the preheater and dissolver zones.

The hydrogen partial pressure is at least about 2,100 psig (147 kg/cm$^2$) and up to 4,000 psi (280 kg/cm$^2$), preferably between about 2,200 to about 3,000 psig (154 and 210 kg/cm$^2$), with between about 2,400 to about 3,000 psi (168 and 210 kg/cm$^2$) being preferred. Hydrogen partial pressure is defined as the product of the total pressure and the mol fraction of hydrogen in the feed gas. The hydrogen feed rate is between about 2.0 and about 6.0, preferably between about 4 and about 4.5 weight percent based upon the weight of the slurry fed.

The slurry undergoing reaction is subjected to three-phase, highly backmixed, continuous flow conditions in dissolver 26. In other words, the dissolver zone is operated with through backmixing conditions as opposed to plug flow conditions, which do not include significant backmixing. The preheater tube 23 is merely a prereactor and it is operated as a heated, plug-flow reactor using a nominal slurry residence time of about 2 to 15 minutes, preferably about 2 minutes.

By controlling the combination of process conditions of the higher hydrogen partial pressure, longer residence time and increased ash recycle in a highly backmixed reactor, the process of the present invention produces a total liquid yield of $C_5$-900° F. ($C_5$-482° C.) of from about 50 or 60 to about 70 weight percent based upon MAF feed coal. Such results are highly unexpected and synergistic, since the predicted maximum increase in total liquid yield as a result of the additive effect of increasing such process variables was a total liquid yield of below 40 weight percent based upon MAF feed coal.

The dissolver effluent passes through line 29 to vapor-liquid separator system 30. Vapor-liquid separation system 30, consisting of a series of heat exchangers and vapor-liquid separators, separates the dissolver effluent into a noncondensed gas stream 32, a condensed light liquid distillate in line 34 and a product slurry in line 56. The condensed light liquid distillate from the separators passes through line 34 to atmospheric fractionator 36. The non-condensed gas in line 32 comprises unreacted hydrogen, methane and other light hydrocarbons, along with $H_2S$ and $CO_2$, and is passed to acid gas removal unit 38 for removal of $H_2S$ and $CO_2$. The hydrogen sulfide recovered is converted to elemental sulfur which is removed from the process through line 40. A portion of the purified gas is passed through line 42 for further processing in cryogenic unit 44 for removal of much of the methane and ethane as pipeline gas which passes through line 46 and for the removal of propane and butane as LPG which passes through line 48. The purified hydrogen in line 50 is blended with the remaining gas from the acid gas treating step in line 52 and comprises the recycle hydrogen for the process.

The liquid slurry from vapor-liquid separators 30 passes through line 56 and comprises liquid solvent, normally solid dissolved coal and catalytic mineral residue. Stream 56 is split into two major streams, 58 and 60, which have the same composition as line 56.

In fractionator 36 the slurry product from line 60 is distilled at atmospheric pressure to remove an overhead naphtha stream through line 62, a middle distillate stream through line 64 and a bottoms stream through line 66. The naphtha stream in line 62 represents the net yield of naphtha from the process. The bottoms stream in line 66 passes to vacuum distillation tower 68. The temperature of the feed to the fractionation system is normally maintained at a sufficiently high level that no additional preheating is needed other than for startup operations.

A blend of the fuel oil from the atmospheric tower in line 64 and the middle distillate recovered from the vacuum tower through line 70 makes up the major fuel oil product of the process and is recovered through line 72. The stream in line 72 comprises 380°-900° F. (193°-482° C.) distillate liquid and a portion thereof can be recycled to the feed slurry mixing tank 12 through line 73 to regulate the solids concentration in the feed slurry. Recycle stream 73 imparts flexibility to the process by allowing variability in the ratio of solvent to total recycle slurry which is recycled, so that this ratio is not fixed for the process by the ratio prevailing in line 58. It also can improve the pumpability of the slurry. The portion of stream 72 that is not recycled through line 73 represents the net yield of distillate liquid from the process.

The bottoms from vacuum tower 68, consisting of all the normally solid dissolved coal, undissolved organic matter and mineral matter of the process, but essentially without any distillate liquid or hydrocarbon gases is discharged by means of line 76, and may be processed as desired. For example, such stream may be passed to a partial oxidation gasifier (not shown) to produce hydrogen for the process in the manner described in U.S. Pat. No. 4,159,236 to Schmid, the disclosure of which is hereby incorporated by reference. A portion of the VTB could be recycled directly to mixing tank 12, if this were desirable.

Figure 2:
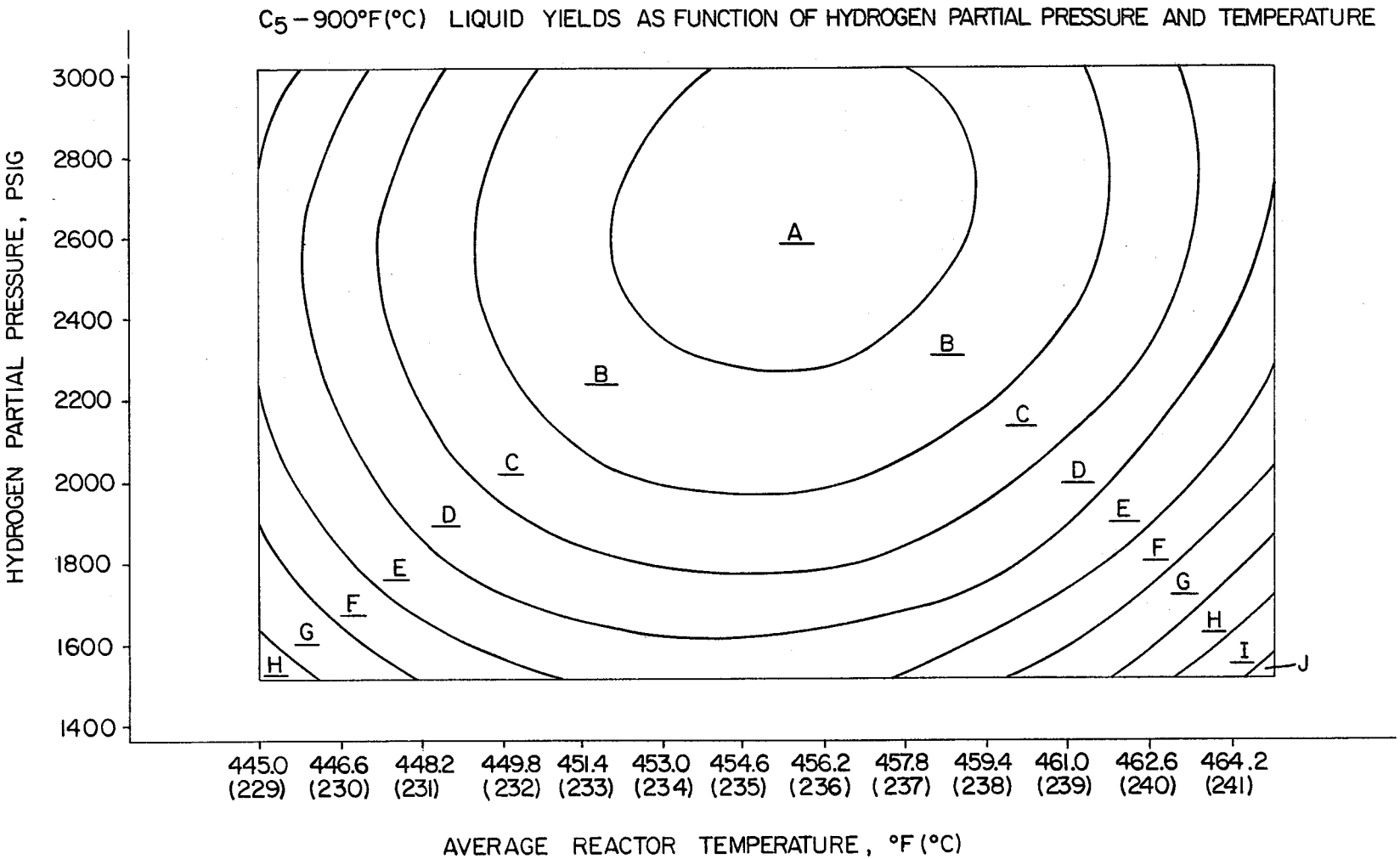
FIG. 2 graphically illustrates $C_5$-900° F. (482° C.) liquid yields as a function of hydrogen partial pressure and temperature.

FIG. 2 is a graphical representation in the form of contour plots showing $C_5$ to 900° F. (482° C.) liquid yields as a function of hydrogen partial pressure and reactor temperature produced using a mathematical model based upon numerous experimental runs. The central regions are the regions of highest liquid yield, i.e., region A represents the condition of highest $C_5$-900° F. (482° C.) yield and regions B, C, etc. the next highest, in order, as shown in Table I, as follows:

TABLE 1

| Region | $C_5$-900° F. (482° C.) Liquid Yield |
|---|---|
| A | 74.68–76.07 |
| B | 71.91–74.68 |
| C | 69.14–71.91 |
| D | 66.37–69.14 |
| E | 63.60–66.37 |
| F | 60.83–63.60 |
| G | 58.06–60.83 |
| H | 55.29–58.06 |
| I | 52.52–55.29 |

TABLE 1-continued

| Region | $C_5$-900° F. (482° C.) Liquid Yield |
|---|---|
| J | 51.14–52.52 |

FIG. 2 shows that as hydrogen partial pressure and temperature are further increased, liquid already formed is converted to gases. Such increased gas yield is undesirable since more hydrogen is required to form gases than liquid, thereby increasing the cost of the process.

The following example is not intended to limit the invention, but rather is presented for purposes of illustration. All percentages are by weight unless otherwise indicated.

EXAMPLE 1

Tests were conducted to demonstrate the effect of the combination of reactor conditions in the present coal liquefaction process upon the yield of $C_5$-900° F. ($C_5$-482° C.) liquid. Pittsburgh seam coal was used in the tests and had the following analysis:

| Pittsburgh Seam Coal (Percent by Weight-Dry Basis) | |
|---|---|
| Carbon | 69.98 |
| Hydrogen | 4.99 |
| Sulfur | 3.39 |
| Nitrogen | 1.24 |
| Oxygen | 8.92 |
| Ash | 11.48 |

A feed slurry is prepared for each test by mixing pulverized coal with liquid solvent and a recycle slurry containing liquid solvent, normally solid dissolved coal and catalytic mineral residue. The feed slurry was formulated using a combination of a light oil fraction (approximate boiling range 193°–282° C., 380°–540° F.) and a heavy oil fraction (approximate boiling range 282°–482° C., 540°–900° F.) as liquid solvent. The coal concentration in the feed slurry was about 25 weight percent and the average dissolver temperature was 460° C. (860° F.).

Seven tests were conducted as a hydrogen partial pressure of about 2,000 psi (140 kg/cm$^2$), a nominal slurry residence time of 1.0 hour and a feed slurry containing 7 weight percent recycle ash.

The average yield of $C_5$-900° F. ($C_5$-482° C.) liquid was 37.0 weight percent.

For comparative purposes two tests were conducted using an increased hydrogen partial pressure of 2,500 psi (175 kg/cm$^2$), a longer slurry residence time of 1.5 hours and a feed slurry containing 10 weight percent recycle ash.

The average yield of $C_5$-900° F. ($C_5$-482° C.) liquid was 65.2 weight percent, which represents a 28.2 increase in liquid yield.

EXAMPLE 2

For comparative purposes, mathematical correlations based upon numerous actual tests made at a 0.5 ton per day pilot plant (A) and a prepilot plant (B) were used to determine the predicted $C_5$-900° F. yield improvement achieved by increasing each of the process variables of hydrogen partial pressure, slurry residence time and recycle mineral residue, respectively, from the lower values used in Example I to the higher values used in Example I, while holding the remaining two variables at lower values. The results are set forth in Table II:

TABLE II

| | | Predicted $C_5$-900° F. Yield Improvement (Wt. % MAF Coal) | |
|---|---|---|---|
| | | Plant A | Plant B |
| $H_2$ Partial Pressure, Psig | 2000–2500 | +6.4 | +4.8 |
| Recycle Ash Wt. % Based on Feed Slurry | 7–10 | +4.0 | +9.5 |
| Nominal Slurry Residence Time, Hours | 1.0–1.5 | +3.9 | +5.1 |
| | | +14.3 | +19.4 |

As seen in Table II the predicted improvement in $C_5$-900° F. liquid yield for increasing each of hydrogen partial pressure, recycle ash concentration and slurry residence time, while holding the other two process variables constant, was +14.3 weight percent for pilot plant A and +19.4 weight percent for prepilot plant B.

However, both of these predicted values are considerably below the actual $C_5$-900° F. yield improvement obtained in the tests of Example I, which was +28.2 weight percent.

What is claimed is:

1. A coal liquefaction process for producing a $C_5$-900° F. liquid yield greater than 50 weight percent MAF coal, which comprises passing hydrogen and a feed slurry comprising mineral-containing feed coal, recycle normally solid dissolved coal, recycle mineral residue and a recycle liquid solvent to a coal liquefaction zone, recycle ash being present in said feed slurry in an amount greater than about 8 weight percent based on the total feed slurry, said feed slurry containing from 20–35 wt. percent coal, said feed slurry being reacted in said coal liquefaction zone under a hydrogen partial pressure of from about 2,100 and about 4,000 psi at a temperature in the range of 430°–470° C., under three-phase, backmixed, continuous flow conditions at a nominal slurry residence time of from about 1.2 to about 2 hours, the values for said recycle ash, hydrogen partial pressure and slurry residence time being selected to produce a $C_5$-900° F. liquid yield of between about 50 to about 70 weight percent based upon MAF coal.

2. The process of claim 1 wherein said feed slurry contains recycle ash in the range of between about 8 to about 14 weight percent based upon the total weight of said feed slurry.

3. The process of claim 2 wherein said feed slurry contains recycle ash in the range of from about 10 to about 14 weight percent based upon the total weight of said feed slurry.

4. The process of claim 1 wherein said $C_5$-900° F. liquid yield is between about 60 and about 70 weight percent based upon MAF feed coal.

5. The process of claim 1 wherein the hydrogen partial pressure is from about 2,200 to about 3,000 psi.

6. The process of claim 5 wherein the hydrogen partial pressure is from about 2,400 to about 3,000 psi.

7. The process of claim 1 wherein the slurry residence time is from about 1.4 to about 1.7 hours.

8. The process of claim 1 wherein said hydrogen partial pressure is between about 2,400 and about 3,000 psi, the slurry residence time is from about 1.4 to about 1.7 hours and the feed slurry contains recycle ash from about 10 to about 14 weight percent based upon the total feed slurry.

9. The process of claim 1 wherein said feed slurry is reacted at a temperature in the range of between about 445° to about 465° C.

10. The process in claim 1 wherein the feed slurry contains about 25 weight percent coal.

* * * * *